US006694988B2

(12) United States Patent
Blazek

(10) Patent No.: US 6,694,988 B2
(45) **Date of Patent: *Feb. 24, 2004**

(54) FILE, PARTICULARLY NAIL FILE

(76) Inventor: Dalibor Blazek, Olbrachtova 600/II, 290 01 Podebrady (CZ)

( * ) Notice: Subject to any disclaimer, the term of this patent is extended or adjusted under 35 U.S.C. 154(b) by 0 days.

This patent is subject to a terminal disclaimer.

(21) Appl. No.: 10/176,508

(22) Filed: Jun. 21, 2002

(65) Prior Publication Data

US 2002/0157681 A1 Oct. 31, 2002

Related U.S. Application Data

(63) Continuation of application No. 09/254,578, filed as application No. PCT/CZ98/00030 on Jul. 9, 1998, now Pat. No. 6,488,034.

(30) Foreign Application Priority Data

Jul. 10, 1997 (CZ) ..... PUV 6936-97

(51) Int. Cl.[7] ..... C07F 5/00
(52) U.S. Cl. ..... 132/764
(58) Field of Search ..... 132/76.4, 76.5; 451/28, 59, 533, 539, 525

(56) References Cited

U.S. PATENT DOCUMENTS

| | | | |
|---|---|---|---|
| 1,907,196 | A | 5/1933 | Aitken |
| 2,308,624 | A | 1/1943 | Pouech |
| 2,699,791 | A | 1/1955 | Hansen |
| 3,648,318 | A | 3/1972 | Tsuruzawa |
| 3,866,618 | A | 2/1975 | Tsukamoto |
| 4,422,465 | A | 12/1983 | Haga |
| 4,497,694 | A | 2/1985 | Bankier |
| 4,785,835 | A | 11/1988 | Bray |
| 5,036,731 | A | 8/1991 | Fletcher |
| 5,119,839 | A | 6/1992 | Rudolph |
| 5,361,786 | A | 11/1994 | Pangburn |
| 5,779,519 | A | 7/1998 | Oliver |
| 5,813,416 | A | 9/1998 | Rudolph |
| 6,012,461 | A | 1/2000 | McKew |
| 6,027,402 | A | 2/2000 | Oliver |
| 6,145,512 | A | 11/2000 | Daley |
| 2002/0066459 | A1 | 6/2002 | Turina |

FOREIGN PATENT DOCUMENTS

| | | |
|---|---|---|
| CA | 2142949 | 7/1996 |
| CH | 237277 | 11/1943 |
| DE | 18 21 813 | 11/1960 |
| DE | 19 71 152 | 10/1967 |
| ES | 8505511 | 9/1985 |

OTHER PUBLICATIONS

Copy of the International Search Report for PCT/CZ98/00030.

*Primary Examiner*—John J. Wilson
*Assistant Examiner*—Robyn Kieu Doan
(74) *Attorney, Agent, or Firm*—Merchant & Gould P.C.

(57) ABSTRACT

The file, the body of which is provided on at least part of its surface with a roughness varying from 10 to 100 $\mu$m, is made of flat, pressed or hardened glass. The file can have a variety of geometrical shapes and cross sections.

30 Claims, 1 Drawing Sheet

FILE, PARTICULARLY NAIL FILE

FIELD OF THE INVENTION

The invention involves a file, particularly for nails, manufactured from glass.

DESCRIPTION OF THE PRIOR ART

Nail files, which are among the principal components of the various sets of cosmetic equipment, are at the present time manufactured from various metals or their alloys, from paper or fabric with a rough finish, as the case may be. Since files destined for such purposes are often used in an environment with high humidity, for example during personal hygiene in the bathroom, it happens in some cases that they corrode or the material from which the file is made becomes moist resulting, on the one hand, in a deterioration in appearance and, on the other, a dulling of the cutting edges of the file from the effects of corrosion and humidity and, thereby, a basic loss of effectiveness. If non-corrosive materials are used in the manufacture of files, which is generally the case, then the disadvantage is the high price. The disadvantage of metal files in which the cutting edges are formed by mechanical means is also the limited "smoothness" of the file, and the fact that by mechanical means it is possible to produce only a limited degree of roughness of the abrasive surface. Likewise, it is simply not possible to produce a series of files with finely graded roughness. It is convenient, in the use of a file, that the side edges be functional, that is rough. Because metal files are flat and too thin, it is not practical to use their side edges to trim the nails.

SUMMARY OF THE INVENTION

The above disadvantages are eliminated in the file according to the invention presented here, the basis of which lies in the fact that it is made from glass roughened on at least part of its surface, with a roughness varying from 10 to 100 $\mu$m.

The advantage of such a file is its absolute resistance to the environment in which it is used. It is significant too that, given its non-corrosive properties, the abrasive surfaces can be kept clean by rinsing in water.

It is important to note here the wide range of surface roughness that can be attained, varying from the smoothest finish with a roughness of 10 $\mu$m to a roughness of around 100 $\mu$m.

The glass body of the file has an oblong board shape and has a point at one end at least. The advantage of such a shape for the glass body of the file is the ease of manipulation in use and, thanks to the point, its practical value for hand hygiene is increased.

Another advantageous solution to be noted is the fact that the glass body of the file is roughened along one whole side at least, having a V-shaped point at the end. The advantages of such a file arm apparent both during use of the file and during its manufacture, when roughening of the whole surface is carried out without the need, for instance, to mask part of the surface during the roughening process by use of acid engraving for example. The point is formed in a V shape, its symmetrical shape facilitating manipulation during use of the file in either the left or the right hand.

A further advantageous feature is the fact that body of the file is roughened along one whole side at least and is ground to a finish on at least one edge. The longitudinal edge formed on one side of the body of the file further increases the functional possibilities of the nail file.

It is possible to form the body of the file so that both edges are bevelled, while the bevelled edge at the end is at an oblique angle to the side edge, so that together they form a point. This variation further increases the wide range of uses for the file.

Another advantageous arrangement for the shape of the body of the file, consisting in the fact that the surface of at least one of the edges and of one end of the body of the file is also roughened, further contributes to increasing its usefulness.

To further improve performance, the edges of the body of the file are rounded. These variations in the shape of the glass file further extend its usefulness for special cases of hand hygiene.

From the point of view of production technology, it is an advantage if the body of the file can be formed from flat or pressed glass.

All the various shapes of the file can have a glass body formed from hardened glass. The advantages of such a treated glass body are its increased stability and particularly in safety in the event of breakage of the whole of the glass body by dropping etc. The hardening of the glass-bodied file gives it properties which arc well-known in such treated glass.

BRIEF DESCRIPTION OF THE DRAWINGS

The invention can be better described by means of the drawings, of which

DESCRIPTION OF THE PREFERRED EMBODIMENTS

Figure 1:
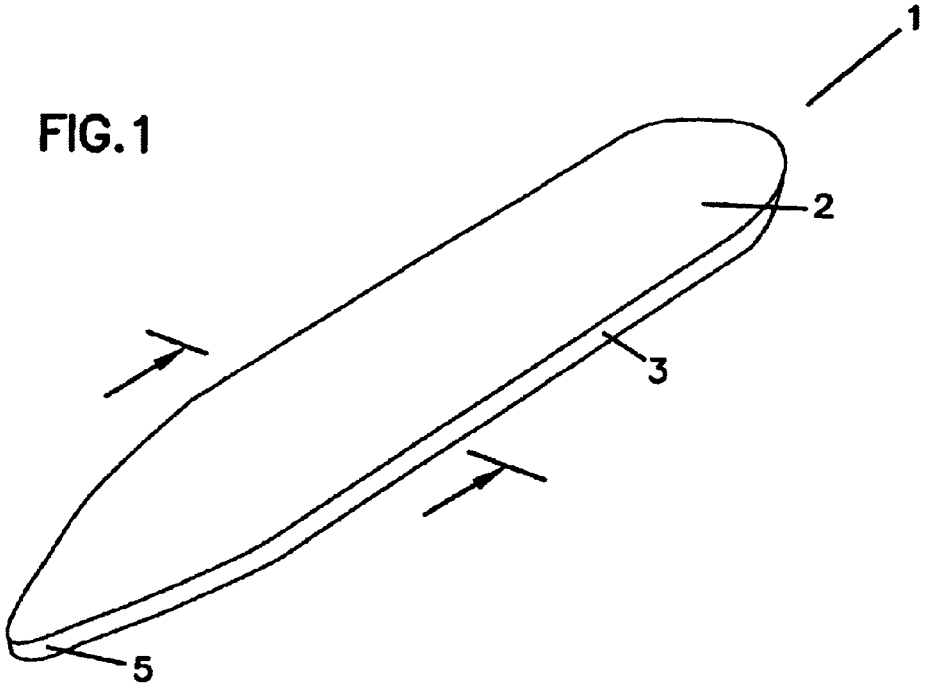
FIG. 1 represents an axonometric overview of the glass body of the file.
Figure 2:
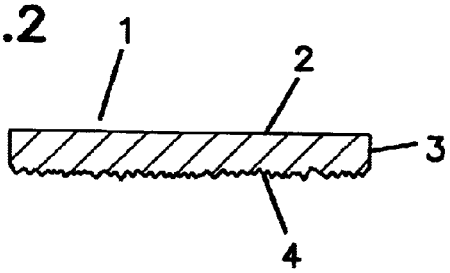
FIG. 2 presents a cross section of the glass body of the file with roughening on one surface.

The file according to FIG. 1 is formed from a glass body 1, shown here in oblong board shape, with a roughening 4 on the surface 2. The roughening 4 is produced by a wide variety of techniques, the choice depending upon the degree of roughness. To produce the smoothest finish, for example around 10 $\mu$m, a chemical process can be used, such as acid engraving with a hydrogen fluoride solution. Greater roughness, of around 100 $\mu$m for instance, can be produced mechanically, by sanding for example. FIG. 2 shows a cross section of the glass body 1 of the file illustrated in FIG. 1, with a roughened finish 4 along the whole of one surface 2.

Figure 3:
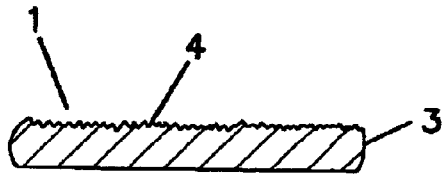
FIG. 3 also shows a cross section of the glass body of the file with roughening on one side and rounded edges. Similarly.
Figure 4:
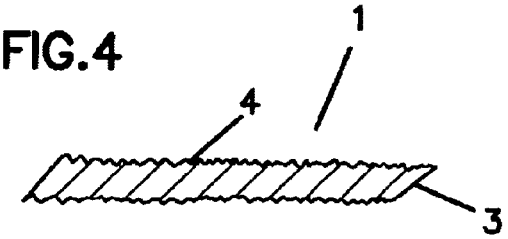
FIG. 4 presents a cross section of the glass body of the file, both of whose edges are bevelled.

FIGS. 3 and 4 illustrate further possible variants on the glass body 1 of the oblong board-shaped file. A cross section is shown of the glass body 1 of the file, with roughening 4 of one surface finish 2, the glass body 1 of the file having rounded edges 3, while the cross section in FIG. 4 presents the glass body 1 of the file with edges 3 bevelled to a sharp finish, the glass body 1 of the file having a rough finish 4 on both surfaces 2.

Industrial Use of the Invention

The glass-bodied file has been described from the point of view of its use as a nail file. This example of use, however, in no way excludes further possible uses in other fields, particularly given the wide range of roughness which can be achieved in the glass-bodied file. A file produced according to this invention with a low degree of roughness, that is to say the finest, can be used in polishing surface, for example, while the coarsest can be used for grinding.

What is claimed is:

1. A file comprising a body, the body comprising first and second sides, first and second edges, a first end, and at least one chemically roughened abrading surface, wherein the body, first and second sides, first and second edges, first end, and the at least one abrading surface are formed of a single, integral stratum, the integral stratum comprising hardened glass.

2. The file of claim 1, wherein the body further includes a second end, and at least one of the ends tapers to a point.

3. The file of claim 1, wherein at least a portion of one of the first and second edges is beveled.

4. The file of claim 1, wherein at least a portion of one of the first and second edges is rounded.

5. The file of claim 1, wherein at least a portion of each of the first and second sides is chemically roughened so that an abrading surface is formed on each side.

6. The file of claim 1, wherein the roughness of the abrading surface is about 10 $\mu$m.

7. The file of claim 1, wherein the abrading surface comprises a multiplicity of peaks, and where the peaks are irregular.

8. A method of making a file, comprising:

using a chemical process to chemically roughen at least a portion of a glass body to produce at least one abrading surface on the glass body; and hardening the glass body.

9. The method of claim 8, wherein the chemical process uses a hydrogen flouride solution.

10. The method of claim 8, wherein the chemical process produces a roughness of about 10 $\mu$m.

11. The method of claim 8, wherein the abrading surface is produced without masking the glass body.

12. A process for making glass nail files, said process comprising the steps of:

(a) obtaining an elongated substrate comprising a glass material and having a top surface and a bottom surface;

(b) chemically etching at least a portion of one of said surfaces to create a rough finish on said surface; and (c) facilitating hardening of said elongated substrate to increase the rigidity and durability of said elongated substrate.

13. A process as recited in claim 12, wherein said step of facilitating hardening comprises:

thermally treating said elongated substrate at at least one predetermined temperature.

14. A process as recited in claim 13, wherein said step of thermally treating comprises:

heating said substrate at a first temperature and then cooling said substrate at a second temperature.

15. A process as recited in claim 12, wherein said step of chemically etching comprises:

soaking said substrate in a solution that facilitates an ionic exchange of ions contained in said glass material with ions released by said solution.

16. A process as recited in claim 15, wherein said solution comprises dissolved salts that facilitate an ionic exchange of ions contained in said glass material with ions released by said solution.

17. A process as recited in claim 15, further comprising the step of:

protecting said substrate from said solution in at least one section where a grinding surface is undesirable.

18. A process as recited in claim 15, wherein said solution comprises potassium.

19. A process as recited in claim 12, wherein said solution comprises hydrofluoric acid and facilitates an ionic exchange of ions contained in said glass material with ions released by said solution.

20. A process as recited in claim 12, wherein said rough finish comprises a substantially uniformly rough finish devoid of sharp edges so as to define a relatively soft grinding surface.

21. A process as recited in claim 12, further comprising the step of:

forming an elongated substrate comprising said glass material.

22. A process as recited in claim 12, further comprising the step of:

forming a handle from said substrate.

23. A process as recited in claim 22, wherein said handle forming step comprises:

protecting at least one predetermined section of said substrate in a manner that isolates said section from said step of chemically etching.

24. A glass nail file for filing human and domestic animal nails, said nail file comprising:

an elongated substrate comprising a glass material, said substrate having a first surface, a second surface opposite said first surface, a first end, a second end and a predetermined thickness defined between said first and second surface; and a virtually permanent grinding surface defined on and by at least a portion of at least one of said surfaces, said grinding surface defining a rough finish devoid of sharp edges.

25. A nail file as recited in claim 24, wherein said grinding surface is formed by chemically etching said surface in a solution that facilitates an ionic exchange of ions contained in said glass material with ions released by said solution.

26. A nail file as recited in claim 25, wherein said solution comprises dissolved salts.

27. A nail file as recited in claim 25, wherein said solution comprises hydrofluoric acid.

28. A nail file as recited in claim 24, further comprising:

a handle proximal at least one end of said first and second ends.

29. A nail file as recited in claim 28, wherein said handle comprises a smooth section defined by said substrate wherein said smooth section is devoid of a grinding surface.

30. A nail file as recited in claim 28, wherein said handle comprises a rigid extension mounted to said end.

* * * * *

UNITED STATES PATENT AND TRADEMARK OFFICE

CERTIFICATE OF CORRECTION

PATENT NO. : 6,694,988 B2
DATED : February 24, 2004
INVENTOR(S) : Blažek

It is certified that error appears in the above-identified patent and that said Letters Patent is hereby corrected as shown below:

Column 1,
Line 56, “file arm” should read -- file are --
Line 63, “that body” should read -- that the body --
Line 65, “to a finish” should read -- to a sharp finish --

Column 2,
Line 22, “in safety” should read -- increased safety --

Signed and Sealed this

Twenty-fifth Day of May, 2004

JON W. DUDAS
*Acting Director of the United States Patent and Trademark Office*

US006694988C1

(12) EX PARTE REEXAMINATION CERTIFICATE (9533rd)

United States Patent
Blazek

(10) Number: US 6,694,988 C1
(45) **Certificate Issued: *Feb. 27, 2013**

(54) FILE, PARTICULARLY NAIL FILE

(75) Inventor: Dalibor Blazek, Podebrady (CZ)

(73) Assignee: J. Blazek Sklo Podebrady S.R.O., Podebrady (CZ)

Reexamination Request:
No. 90/011,945, Nov. 14, 2011

Reexamination Certificate for:

| | |
|---|---|
| Patent No.: | **6,694,988** |
| Issued: | **Feb. 24, 2004** |
| Appl. No.: | **10/176,508** |
| Filed: | **Jun. 21, 2002** |

( * ) Notice: This patent is subject to a terminal disclaimer.

Related U.S. Application Data

(63) Continuation of application No. 09/254,578, filed as application No. PCT/CZ98/00030 on Jul. 9, 1998, now Pat. No. 6,488,034.

(30) Foreign Application Priority Data

Jul. 10, 1997 (CZ) ..... PUV 6936-97

(51) Int. Cl.
*C07F 5/00* (2006.01)

(52) U.S. Cl. ..... 132/76.4

(58) Field of Classification Search ..... None
See application file for complete search history.

(56) References Cited

To view the complete listing of prior art documents cited during the proceeding for Reexamination Control Number 90/011,945, please refer to the USPTO's public Patent Application Information Retrieval (PAIR) system under the Display References tab.

*Primary Examiner* — Catherine S. Williams

(57) ABSTRACT

The file, the body of which is provided on at least part of its surface with a roughness varying from 10 to 100 μm, is made of flat, pressed or hardened glass. The file can have a variety of geometrical shapes and cross sections.

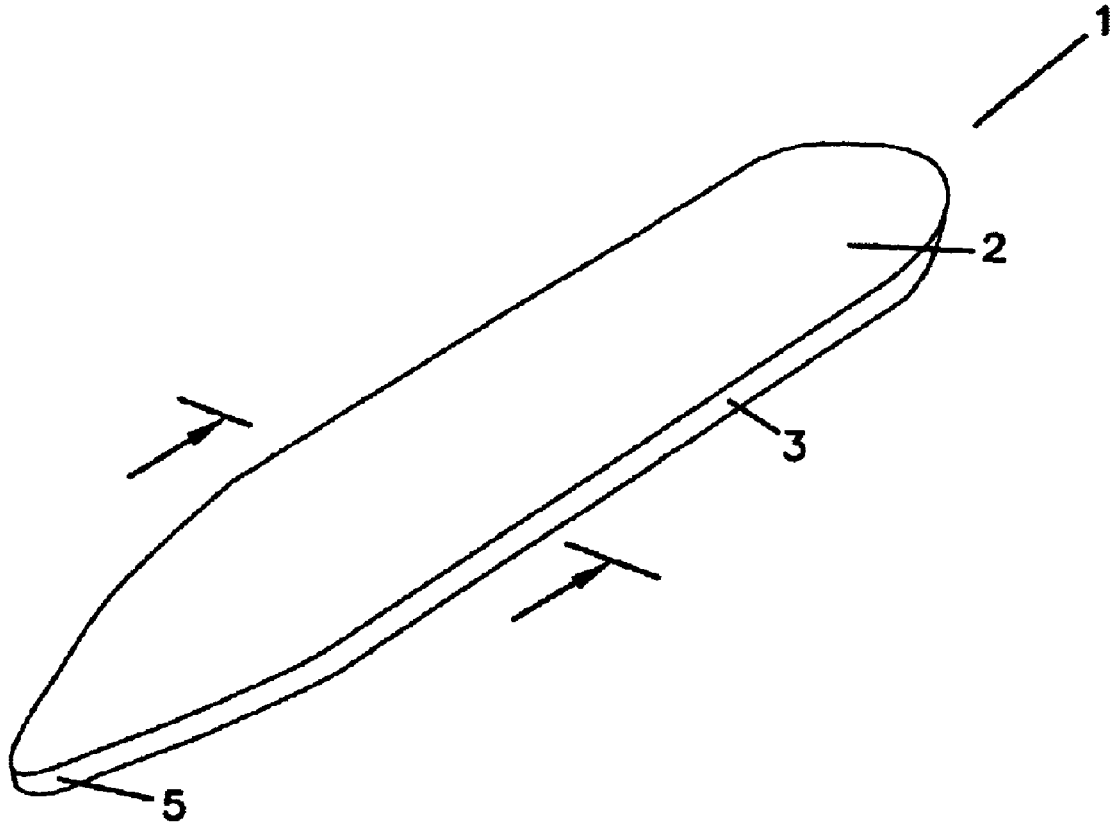

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8-23 is confirmed.

Claim 7 is cancelled.

Claims 1 and 24 are determined to be patentable as amended.

Claims 2-6 and 25-30, dependent on an amended claim, are determined to be patentable.

1. A file comprising a body, the body comprising first and second sides, first and second edges, a first end, and at least one chemically roughened abrading surface, wherein the body, first and second sides, first and second edges, first end, and the at least one abrading surface are formed of a single, integral stratum, the integral stratum comprising hardened glass*, and wherein the abrading surface comprises a multiplicity of peaks, and the peaks are irregular*.

24. A glass nail file for filing human and domestic animal nails, said nail file comprising:

an elongated substrate comprising a *single integral stratum of hardened* glass material, said substrate having a first surface, a second surface opposite said first surface, a first end, a second end and a predetermined thickness defined between said first and second surface; and a virtually permanent grinding surface defined on and by at least a portion of at least one of said surfaces, said grinding surface defining a rough finish devoid of sharp edges *and wherein the grinding surface is chemically roughened and comprises a multiplicity of peaks, and wherein the peaks are irregular*.

* * * * *